US005920634A

United States Patent [19]

Chiquette

[11] Patent Number: 5,920,634

[45] Date of Patent: Jul. 6, 1999

[54] ACTIVATABLE AUDIO ADVERTISING DISPLAY STANDARD

[76] Inventor: Grace Rojan Chiquette, 5410 E. Farmdale Ave., Mesa, Ariz. 85206

[21] Appl. No.: 08/747,751

[22] Filed: Nov. 13, 1996

[51] Int. Cl.[6] ..... G09F 27/00

[52] U.S. Cl. ..... 381/124; 40/906; 40/455

[58] Field of Search ..... 381/124; 704/272; 40/906, 455

[56] References Cited

U.S. PATENT DOCUMENTS

| | | | |
|---|---|---|---|
| 1,650,630 | 11/1927 | Klein . | |
| 1,804,297 | 5/1931 | Wintz . | |
| 1,810,264 | 6/1931 | Bonitz . | |
| 2,615,993 | 10/1952 | Carter . | |
| 3,742,203 | 6/1973 | Noe . | |
| 4,691,316 | 9/1987 | Phillips | 371/20 |
| 4,721,947 | 1/1988 | Brown | 340/540 |
| 5,359,374 | 10/1994 | Schwartz | 40/152.1 |
| 5,467,076 | 11/1995 | Ruocco et al. | 340/571 |
| 5,720,123 | 2/1998 | Taylor . | |

*Primary Examiner*—Forester W. Isen
*Attorney, Agent, or Firm*—Paula L. Bentley

[57] ABSTRACT

An audio advertising display standard for use as a placard, real estate sale/lease advertising standard, or other advertising uses, that supports a visual display panel and provides auditory information about a property, place of business, event, exhibit, or object upon activation by an attendant listener. The advertising standard of the present invention preferably comprises a combination of a hollow post and orthogonal arm, means for supporting a display panel, means for playing back a prerecorded audio message whenever activated including a speaker mounted on the post or arm, and a publicly accessible means for activating the play back means. The display standard of the present invention may further include means for recording an audio message for subsequent play back including a microphone, means for activating the recording means, and/or means for illuminating the display panel supported by the standard. The audio message is preferably stored on an integrated chip but can be held on a tape, disk, or other sound recording storage device.

27 Claims, 5 Drawing Sheets

54
40
41
2
10
35

54
21
41
40
33
22
2
38
10
35

54
52
34
41
2
10
35

21
40A
22
2
38A
10

2
39A
10

ACTIVATABLE AUDIO ADVERTISING DISPLAY STANDARD

BACKGROUND OF THE INVENTION

The present invention relates to the fields of advertising display standards and sound reproduction technologies, and more particularly to an advertising display standard that replays a prerecorded audio message when activated by an attendant listener and provides a place to hang/support a visual display. The present invention may also include recording capability, and/or automatic illumination of a visual advertising display hung/supported thereon when ambient light is low.

Making information available to consumers is an important aspect of the advertising profession. Advertising displays, such as those posted on the premises of the real estate for sale/lease, are an indispensable part of attracting and notifying potential customers of the availability of the item, service or property. The free standing advertising displays in common use today consist simply of a flat visual panel hanging from an upright standard that contains a very short informational message such as a phone number, name, title, and perhaps some minimal detail about the thing advertised, etc.

One problem with the advertising displays just described is that the extremely short visual message limits the amount of information a seller/advertiser can provide to a potential interested party. In addition, the advertisement is limited to the written form of expression. What is needed is a means for both increasing the amount of information and providing that information in a more intriguing manner than mere written expression.

Realty advertisers have attempted to answer the problem of the limited amount of information by keeping a steady supply of paper flyers containing more detailed information in a tube or box attached to a realty standard. But, like the visual panel, the flyer information is limited to mere written expression. Another drawback with using paper flyers to provide supplementary advertising information is that the flyers must be routinely checked and replenished to be certain a supply of flyers is always available.

Another attempt to answer the problem of the limited ability of visual displays to educate and interest potential customers is taught in U.S. Pat. No. 5,467,076 (Ruocco et al.) which describes a realty sign containing a radio transmitter that continuously broadcasts an advertising message contained on a continuously replaying taped recording. Two drawbacks with the Ruocco et al. advertising display are that the broadcasted message is only available to the potential buyer/lessee who has a radio, and, for those who do have a radio, the space between the transmitter and the radio must be free of interference for a clear message to be broadcasted and heard. Another problem is that where two or more advertising displays for different properties are in close proximity to one another, all must either broadcast at different radio frequencies or must broadcast the same message.

Accordingly, the advertising art still lacks an advertising display standard that provides an abundance of specific information day or night to an interested bystander that does not require restocking, and further, provides more than mere written expression that does not require the customer to possess his or her own accessory such as a radio.

SUMMARY OF THE INVENTION

The present invention relates to an advertising display standard for supporting a visual display panel and producing a prerecorded message when activated by an attendant listener. The present invention may also record as well as produce sound, and, illuminate a visual display panel hung thereon. The audio advertising standard of the present invention increases the quantity and quality of information a display standard can provide and reaches a wider audience than ever before possible. The present invention has broad advertising applications beyond that of real estate sales and leasing, including use as a placard providing information about a place of business, event or object.

The present invention combines an upright support such as a post and an arm, a means for supporting a display panel, a means for playing back recorded or stored sound, a means for activating the sound play back means, and a means for providing electrical power. The instant invention may also include a means for recording sound and a means for activating the recording means.

The sound play back means is defined herein as any sound recording technology that can play back or reproduce stored sound signals into an audible form corresponding to their original sound. The sound recording means is herein defined as any sound recording technology that can preserve sound, that is, that can convert audible sounds into sound signals and store or otherwise preserve those signals for subsequent reproduction. The play back means is electrically connected to the play back activating means and both are located in or on the upright support such that when the play back activating means is physically activated from a publicly accessible position an audible sound is produced from stored sound signals. The recording means is electrically connected to the record activating means and both are located in or on the upright support such that when the record activating means is physically activated, audible sound is converted into sound signals and preserved or stored. It should be apparent that the recording means and the play back means may share parts whenever both means are combined in the same embodiment, and likewise, the record activating means and the play back activating means may likewise share parts cooperatively whenever both are combined in the same embodiment.

Preferably, the play back means utilizes an integrated chip that can process sound signals for preservation and reproduction (hence, voice chip). Voice chips are readily available off-the-shelf integrated chips that are accompanied by literature and/or a data book published by the voice chip manufacturer identifying pin assignments and suggesting external circuit examples for implementing the storage, play back and record functions of the voice chip. The preferred play back means includes such a voice chip electrically connected to a speaker so as to produce audible sound corresponding to the sound signals already stored on the voice chip whenever the voice chip is activated by the play back activating means, preferably an electrical push button switch. If recording means is to be provided too, it preferably includes a microphone electrically connected to the voice chip for recording and storing sound signals corresponding to audible sounds coming into the microphone whenever the voice chip is selectively activated by the record activating means, said record activating means in the form of a second switch that activates the recording means, or, in the form of a system of switches that may include the play back activation means switch, that cooperatively work together to selectively activate the recording and play back means.

It should be evident that although a sound recording technology utilizing a voice chip is preferred, other sound recording technologies, analog and/or digital, such as those utilizing tape, disk or IC, can be used and are intended to be included within the scope of this invention. These recording technologies and their components are well known and readily available in the sound recording arts.

Where both play back and recording functions are provided in an embodiment of the present invention, the play back activating means and record activating means may even comprise a cooperative arrangement of switches and perhaps other components that are electrically connected to the voice chip to provide activating means that selectively activates either the play back function or the record function of the voice chip.

It should be apparent that an interested listener need not have a radio or other accessory to hear the audio message because the present invention does not involve broadcasting to deliver its message, nor is the quality and quantity of the information delivered by the present invention effected by surrounding radio interference.

The panel supporting means of the subject invention can be any means for supporting a display panel located on the upright support. It should be plain that the display panel may not be an element of the present invention, but rather a work piece which is hung or otherwise supported by the upright support. Examples of panel supporting means include a link, bracket, slot, hook, clasp, fastener, loop, coupling, clip, and their equivalents. The panel supporting means may even be an integral part of the upright support.

The power means of the present invention may be partially or entirely housed on the upright support. The power means could bring alternating current (AC) from an ordinary household outlet (about 110 to 120 volts in the United States) into the upright support and modify that current to the appropriate type of current (AC, or direct current DC) for use in the various electrically powered components of the present invention. However, the power means may also utilize electrical energy from other sources such as one or more batteries or solar cells, or a combination of energy sources. An AC outlet is the preferred power source over batteries or solar cells because it eliminates the necessity of checking and replacing batteries thereby providing audio information on demand day or night unlike the advertising standards having paper flyers which need to be frequently checked and restocked.

Means for illuminating a panel supported by the standard of the present invention may also be added to provide for visibility of the panel when ambient light is low. The illumination means is located on the post or arm and is preferably in the form of a photocell electrically connected to at least one electrical lamp located on the upright support.

Accordingly, it is a prime objective of the present invention to provide an improved and novel advertising display standard for supporting a display panel that reproduces a prerecorded message when activated.

Still another object of the present invention is to provide a novel advertising display standard for supporting a display panel that can record sound as well as play back stored sound upon demand.

BRIEF DESCRIPTION OF THE PREFERRED EMBODIMENTS

FIG. 5 is a schematic for the play back means, the record means, the play back activation means, and the record activation means of a second preferred embodiment of the present invention.

DESCRIPTION OF THE PREFERRED EMBODIMENTS

Referring to FIGS. 1–6D of the drawings, preferred embodiments of the present invention are now presented. The following table represent preferred values for capacitors and resistor reference numbers found in the schematics of FIGS. 3, 4, and 5:

Table of Values for Capacitors and Resistors

| Ref. # | Value | Ref. # | Value | Ref. # | Value | Ref. # | Value |
|---|---|---|---|---|---|---|---|
| C1 | 100 μF (35 V) | C11 | 0.1 μF | R1 | 10 ohms | R10 | 4.7 K |
| C2 | 220 μF (16 V) | C12 | 0.1 μF | R2 | 1 K | R11 | 47 K |
| C3 | 0.1 μF | C13 | 0.01 μF | R3 | 10 K | R12 | 10 K |
| C4 | 1.0 μF | C14 | 4.7 μF | R4 | 10 K | R13 | 1 K |
| C6 | 0.1 μF | C15 | 0.1 μF | R5 | 4.7 K | R14 | 10 K |
| C7 | 0.033 μF | C16 | 0.033 μF | R6 | 10 K | R15 | 120 K |
| C8 | 220 μF (16 V) | C17 | 220 μF (16 V) | R7 | 510 ohms | R16 | 56 K |
| C9 | 0.1 μF | C18 | 0.047 μF | R8 | 470 K | R17 | 1 K |
| C10 | 220 μF (16 V) | C19 | 1.0 μF | R9 | 5.1 K | R18 | 4.7 K |
| | | | | | | R19 | 47 K |

(μF = microfarad; K = kilohms)

Figure 1:
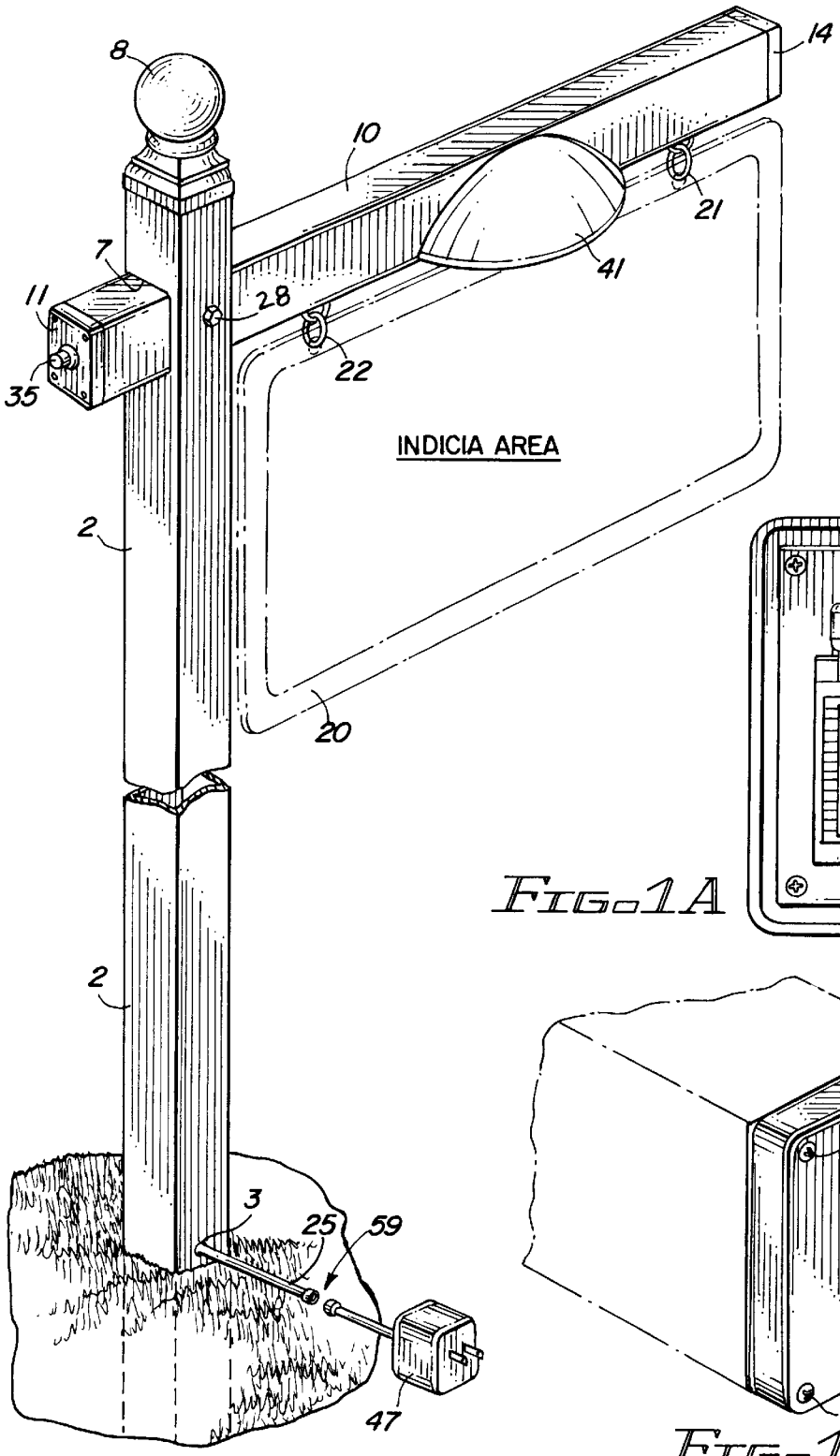
FIG. 1 is a perspective view of a first preferred embodiment of the present invention.

Referring now to FIG. 1, a first preferred embodiment of the present invention featuring audio play back capabilities is shown comprising a hollow arm 10 orthogonally inserted through a first arm receiving aperture (not visible) and a second arm receiving aperture 7 (said first and second arm receiving apertures measuring about 2.5×3.5 inches) of a hollow post 2 then secured into place with bolt 28 as shown. Arm 10 is made of plastic vinyl about 0.080 inches thick and having dimensions of about 2.5×3.5×38.0 inches. Post 2 is similarly made of plastic vinyl about 0.080 inches thick and having dimensions of about 3.5×3.5×67.0 inches. Two metal links 21 and 22 were mounted in the lower surface of arm 10 to provide means for hanging a panel 20 thereon.

Top cap 8 was secured over the upper open end of post 2 to protect its interior from the weather. A cable aperture 3 was made near the lower end of post 2 for allowing a power cable 25 to extend out from the hollow interior of post 2. Arm 10 has a bottom opening aperture 38 in the area where arm 10 intersects with post 2 to provide cable 25 access to the interior of arm 10 (shown in FIG. 2B). Two 7 watt lamp fixtures, 40 and 41, were mounted on arm 10, lamp 41 on the front of arm 10 and lamp 40 on the back of arm 10 (shown in FIGS. 2A and 2B).

Figure 3:
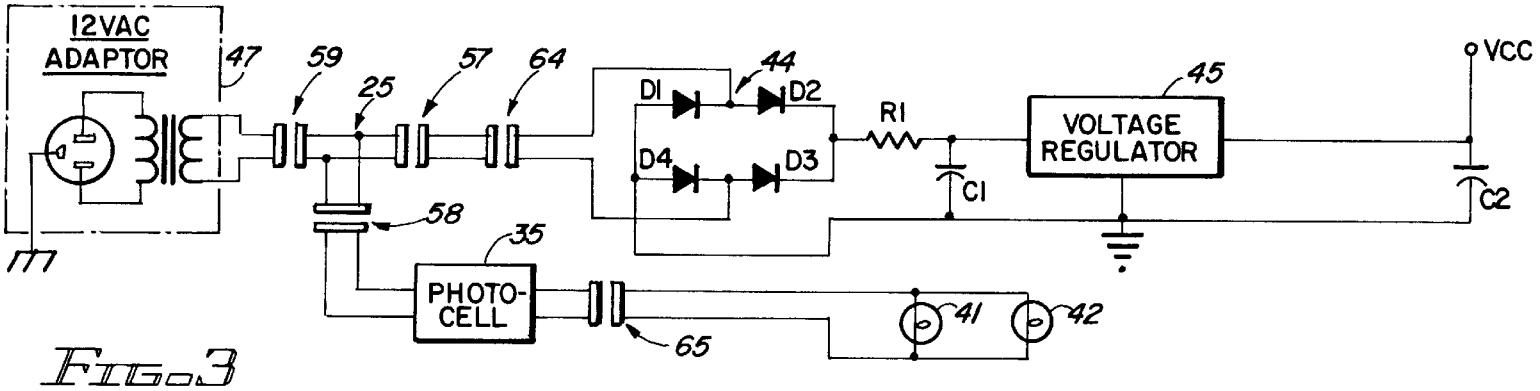
FIG. 3 is a schematic for the power and lighting of a first and second preferred embodiment of the present invention.

Arm 10 has a left endcap 11 and a right endcap 14 covering the open ends of arm 10 as shown in FIG. 1. A photocell 35 for controlling lamps 40 and 41, such as Photocontrol Model SS-724 made by THE DON-ELL CORPORATION of Sylvania, Ohio, was mounted in an aperture on endcap 11 with the wiring of photocell 35 extending into the interior of arm 10. Photocell 35 was electrically connected to lamps 40 and 41, and cable 25 (FIG. 3). The electrical connection between cable 25 and photocell 35 included a plug and receptacle type connector set 57 located near aperture 38 as shown in the schematic of FIG. 3, for ease of assembly and to make it possible to ship the present embodiment with arm 10 disengaged from post 2. Another plug and receptacle connector set 65 was placed in the electrical connection between photocell 35 and lamps 41 and 42, near aperture 38 for ease of assembly. Endcap 14 was then secured over the right end of arm 10 with security screws.

Figure 1A:
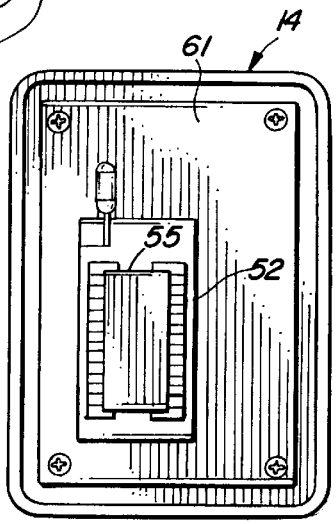
FIG. 1A is an enlarged view of the inner surface of the endcap of a first embodiment of the present invention.
Figure 1B:
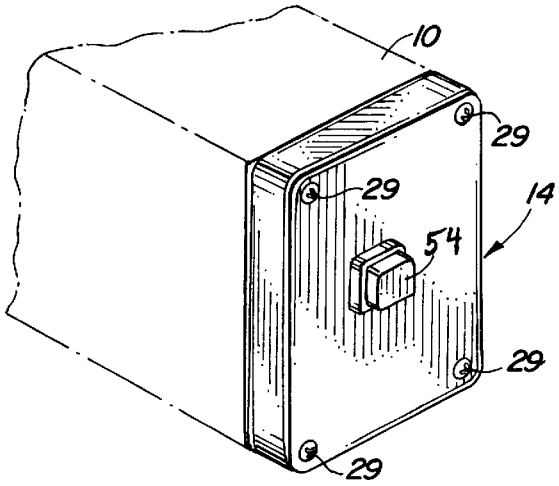
FIG. 1B is an enlarged view of the outer surface of the endcap of a first embodiment of a present invention.
Figures 2A, 2B, 2C, 6C, 6D:
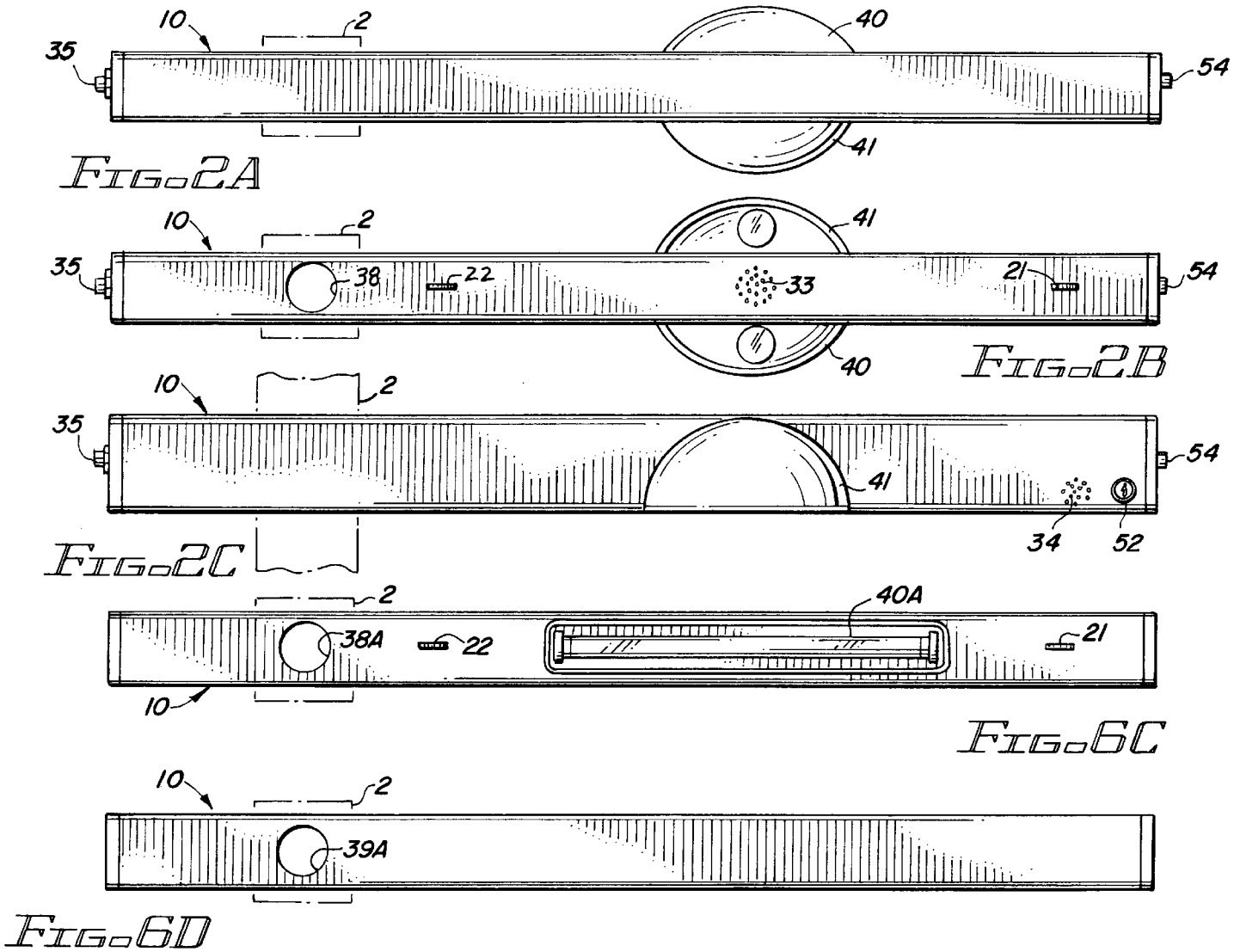
FIG. 2A is a top view of the arm of a first and second preferred embodiment of the present invention.
FIG. 2B is a bottom view of the arm of a first and second preferred embodiment of the present invention.
FIG. 2C is a front view of the arm of a second preferred embodiment of the present invention.
FIG. 6C is a bottom view of the arm of FIG. 6.
FIG. 6D is a top view of the arm of FIG. 6.
Figure 4:
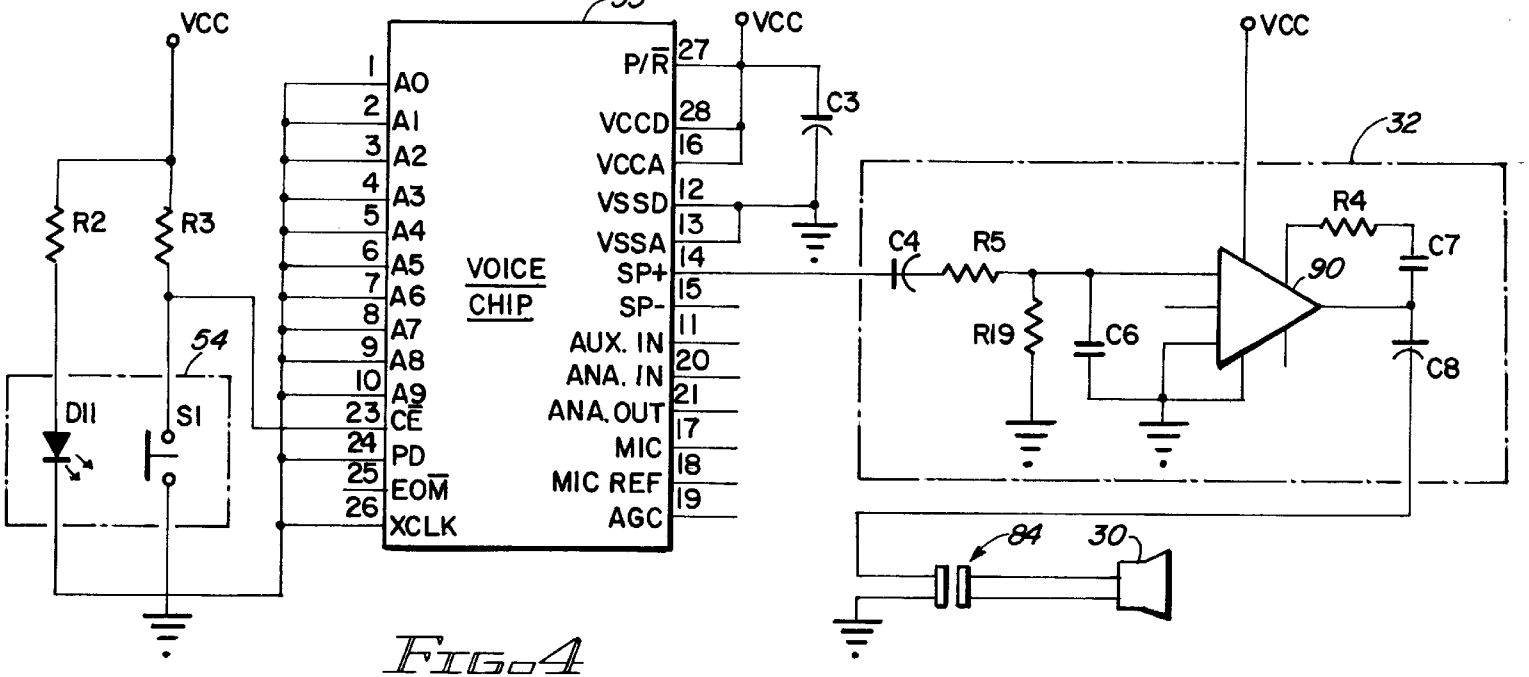
FIG. 4 is a schematic for the play back means and play back activation means of a first preferred embodiment of the present invention.
Figure 4:
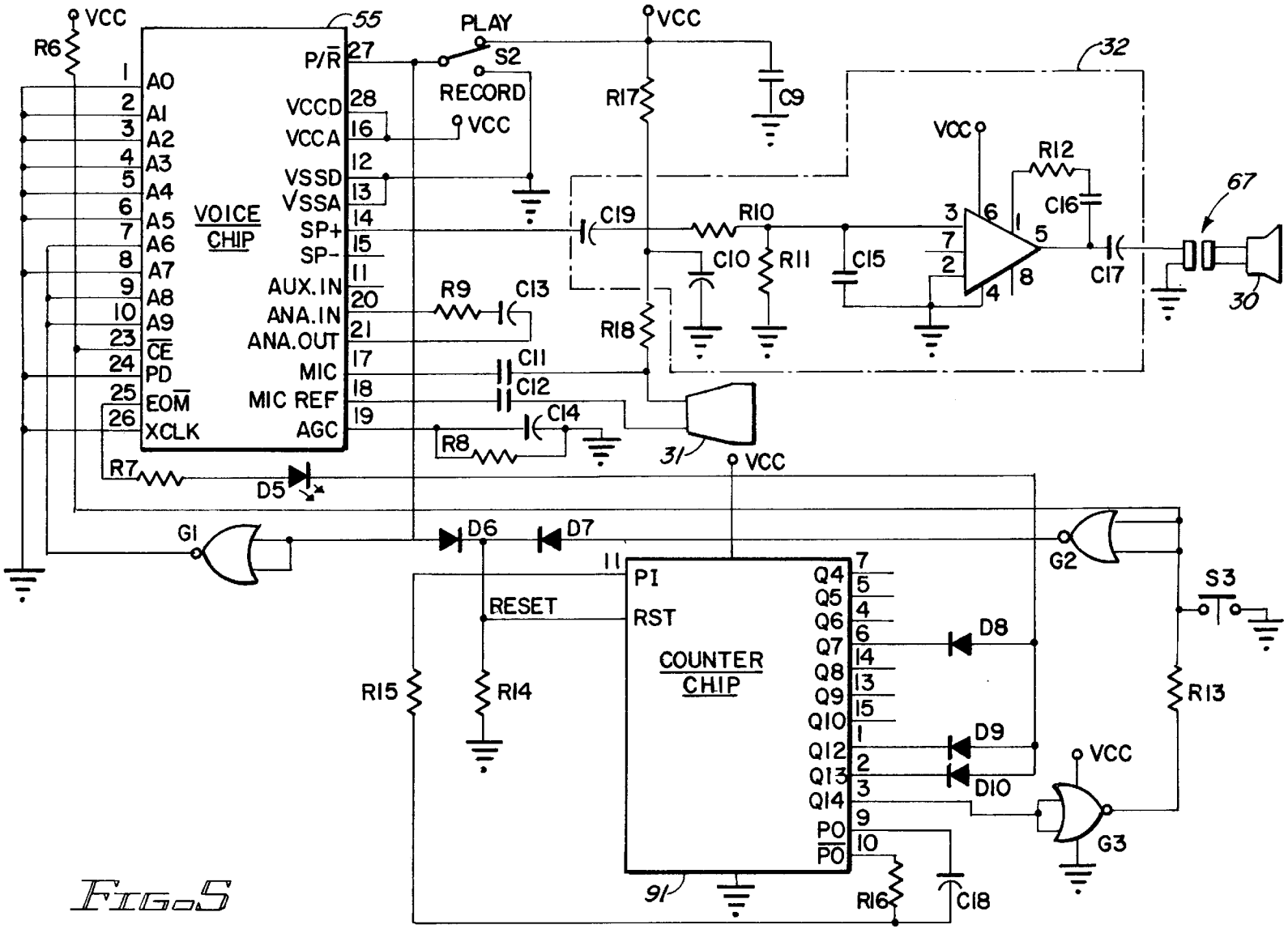

As shown in FIGS. 1A, 1B, 2A, 2B and the schematic of FIG. 4, the play back means comprises a voice chip 55 and its external circuitry located on a printed circuit board 61 that is secured to the inside surface of endcap 14 with four security screws 29 as shown in FIGS. 1A and 1B. Referring now to FIG. 4, the external circuitry of voice chip 55 includes: a zero insertion force chip socket 52 (ZIF socket), an amplifier 32, and a speaker 30. ZIF socket 52 was mounted on printed circuit board 61 and removably receives voice chip 55 and clamps the pins of voice chip 55 into contact with circuit board 61 as shown in FIG. 1A. A play back activating means (FIG. 4) comprises a momentary contact push button switch S1, a light emitting diode D11 (switch S1 and LED D11 together hereinafter constitute switch 54), and resistors R2 and R3, electrically connected to voice chip 55. Switch 54 was also mounted in an aperture of endcap 14 so that the button portion of switch 54 was publicly accessible as shown in FIG. 1B. Speaker 30 is preferably an 8 ohm, weather resistant speaker, and was mounted in a speaker aperture 33 on the bottom surface of arm 10 as shown in FIG. 2B. Although voice chip 55 contains a speaker amplifier, better results for this particular application were achieved when amplifier 32 was added to the external circuitry of voice chip 55.

Amplifier 32 comprises capacitors C4, C6, C7, and C8, resistors R5, R19 and R4, and an amplifier integrated chip 90 electrically connected as shown in FIG. 4. Amplifier chip 90 is preferably an LM386, a widely manufactured and available IC. Amplifier 32 was mounted on printed circuit board 61 and electrically connected to voice chip 55 and speaker 30, having a plug and receptacle type connector set 84 between amplifier 32 and speaker 30 as represented in the schematic of FIG. 4. Endcap 14 was then placed over the open end of arm 10 and preferably secured with a keyed cam lock (not shown) to allow easy access to the components located on endcap 14 and inside arm 10, and to discourage unauthorized tampering.

Voice chip 55 is preferably an off the shelf, manual switch controllable, integrated voice chip utilizing CMOS analog signal processing technology and floating-gate nonvolatile EEPROM memory technology for storing, recording and playing back sound in its natural analog state, such as the cascadeable (dual in line) integrated chip, "CHIPCORDER" part no. ISD 2560, described in the 1995 Product Guide of INFORMATION STORAGE DEVICES, INC. headquartered in San Jose, Calif. ISD 2560 is an IC integrating an oscillator, microphone pre-amplifier, automatic gain control, anti-aliasing filter, smoothing filter, and speaker amplifier on a single chip with the capacity to store/replay up to 60 seconds of sound, and featuring an 8.0 KHz input sample rate, 480 K cells density, and 3.4 KHz upper pass band. Specific details about the ISD 2560 chip and suggested exterior circuits with which to use the ISD 2560 chip are amply disclosed in: *ISD Data Book, Voice Recording & Playback ICs,* 1996 2nd Edition, published by and readily available from INTEGRATED STORAGE DEVICES, INC., San Jose, Calif., and incorporated herein by reference.

As schematically represented in FIG. 3, the power means and lighting are preferably include a transformer 47 that changes electrical power originating from a 11–120 VAC outlet to 12 VAC for use in powering lamps 40 and 41, and also further modifies 12 VAC through bridge rectifier 44 and voltage regulator 45, both located on printed circuit board 61, to produce 5 volts DC for use in the play back means and play back activation means. A watertight plug and receptacle type connector set 59 (FIGS. 1 and 3) was placed in cable 25 between transformer 47 and post aperture 3 to provide means, where necessary, for placing an additional length of extension cable (not depicted) to the end of cable 25 thereby, where necessary, extending cable 25 to reach the end of the cable belonging to adaptor 47. In use, cable 25 (and said extension cable where used) is preferably hidden from view and placed so as not to pose a tripping or other hazard by burying, taping, tacking or any other means necessary to satisfy the aesthetic and safety objectives of the user. A plug and receptacle connector set 64 was placed in cable 25 at board 61 and between bridge 44 and connector set 57 for ease of assembly.

To use the first embodiment just disclosed, the post is planted into the ground as described below and a message is recorded or programmed on voice chip 55 using any compatible voice recorder, or external recording circuit such as those suggested by voice chip 55 manufacturer's specifications and data, cited above. Voice chip 55 is then clamped into ZIF socket 52 and endcap 14 replaced. Pressing button switch 54 results in the message stored on voice chip 55 being reproduced through speaker 30. It should be evident that voice chip 55 may be removed and reprogrammed to contain a new message. Lamps 40 and 41 automatically actuate whenever ambient light is low.

Referring now to FIGS. 2A–C, 3, and 5, a second preferred embodiment of the present invention is disclosed that in appearance is similar to, and is made in a manner similar to said first embodiment disclosed above except: (1) the front view of an arm 10 looks like that of FIG. 2C rather than that shown in FIG. 1; (2) said second embodiment contains a means for recording in addition to a means for play back, and, a means for activating the recording means that cooperatively works with a means for activating the play back means; and (3) a printed circuit board 61 of said second embodiment containing the relevant electrical components of the play back means, recording means, play back activation means, and record activation means, was mounted just inside arm 10 behind endcap 14 rather than on the inner surface of endcap 14 because board 61 was now too large to fit on the inner surface of endcap 14.

Referring now to the schematic of FIG. 5, the recording means includes a microphone 31 electrically connected to voice chip 55 and mounted behind a front arm aperture 34 (FIG. 2C). The play back means includes a speaker 30 mounted behind a bottom aperture 33 in the underside of arm 10 (FIG. 2B) and electrically connected to an amplifier device 32 and voice chip 55. A plug and receptacle type connector set 67 was placed between amplifier 32 and speaker 30 for ease of assembly. Values for the other electrical components disclosed in FIG. 5 are listed in the Table of Values above.

As shown in FIG. 5 the play back activating means and the record activating means preferably include a toggle switch S2 cooperatively associated with a momentary push button type switch S3 having an opaque plastic button portion, three NOR gates G1–3, a counter chip 91, and other electronic components as shown to result in selective activation of the play back means and the recording means. Values for the resistor and capacitor components shown are listed above in the Table of Values. Diodes D6–10 are 1N4148 diodes, and diode D5 is a LED preferably located in the opaque, plastic button portion of switch S3. Toggle switch S2 is preferably a key operated, two contact selector switch normally in a first contact position (the ready to play back position for this embodiment) and switchable to a second contact position (the ready to record position for this embodiment) whenever a key is inserted and turned, such as the "ELECTRICAL-LOCK SWITCH," Lock No. 3535BDDC in Catalog No. D-4/95 made by the CHICAGO LOCK CO., Chicago, Ill. In Lock No. 3535BDDC, the key cannot be removed unless it is first returned to the first contact position (play back position) thereby insuring that the present invention will be normally left in the ready to play back mode. Counter chip 91 is preferably a ripple counter such as the 14-stage ripple carry binary counter in Order No. CD4060BC, made by NATIONAL SEMICONDUCTOR, of Santa Clara, Calif. Specific information regarding the CD4060BC can be obtained from literature and/or data books published by the manufacturer, and is incorporated herein by reference.

In operation, the record function of the present embodiment is activated by placing toggle switch S2 in the record or second position thereby connecting the play back/record pin (P/R) to common on voice chip 55. This LO signal on P/R pin programs voice chip 55 for the record process. At the same time this places a LO signal on the input to NOR gate G1 which in turn places a HI signal on address lines A6, A8 and A9 of voice chip 55 placing voice chip 55 in the push button mode. Pushing button switch S3 connects the chip enabling pin (CE) on voice chip 55 to common which initiates the record function. At the same time this places a LO signal on the inputs to NOR gate G2 which in turn produces a HI on the output of gate G2 placing a HI signal on the reset pin RST of counter chip 91 resetting the counter outputs to zero. Counter chip 91 immediately starts a 60 second countdown. For the first 45 seconds of recording, LED D5 (located inside the button portion of switch S3, together switch 53 and D5 constitute switch 54 of FIG. 2C) is "ON" steadily, then blinks for the last 15 seconds indicating that the 60 second recording time limit is running out. When recording a 60 second message, voice chip 55 automatically stops the recording process and D5 shuts "OFF." When recording a message less than 60 seconds in duration, the recording process is stopped by pressing S3 again, and D5 shuts "OFF." Whenever recording is stopped, voice chip 55 automatically sets an internal EOM (end of message) marker at the end of the message.

The play back mode operates by placing toggle switch S2 in the play back or first position, thereby connecting P/R pin of voice chip 55 to VCC. This HI signal on said P/R pin programs voice chip 55 for the play back process. At the same time this places a HI signal on the input to gate G1 which in turn places a LO signal on address lines A6, A8 and A9 on voice chip 55 placing voice chip 55 in the normal mode. Pushing button switch S3 connects CE pin of voice chip 55 to common which initiates the play back function. At the same time this places a LO signal on the inputs to NOR gate G2 which in turn produces a HI on the output of gate G2 placing a HI signal on the restart pin RST of counter chip 91 resetting the counter outputs to zero. The play back process automatically stops when the internal EOM marker, set during the recording process, is reached.

To use the second embodiment disclosed above, post 2 is planted into the ground as described below and a message is recorded or programmed on voice chip 55 by clamping voice chip 55 into ZIF socket 52, changing switch S2 to the second or record position, pushing button switch S3 and speaking into microphone 31. Alternatively, voice chip 55 may be programmed or recorded upon by any off-site voice recorder or external circuit compatible with voice chip 55, including a recorder having circuitry like the circuitry of FIG. 5. After clamping voice chip 55 containing the desired message into ZIF socket 52, endcap 14 is replaced and switch S2 is returned to the first contact or play back position. A subsequent push on button switch S3 activates voice chip 55 which then plays back the recorded message through speaker 30.

Figures 6, 6A, 6B:
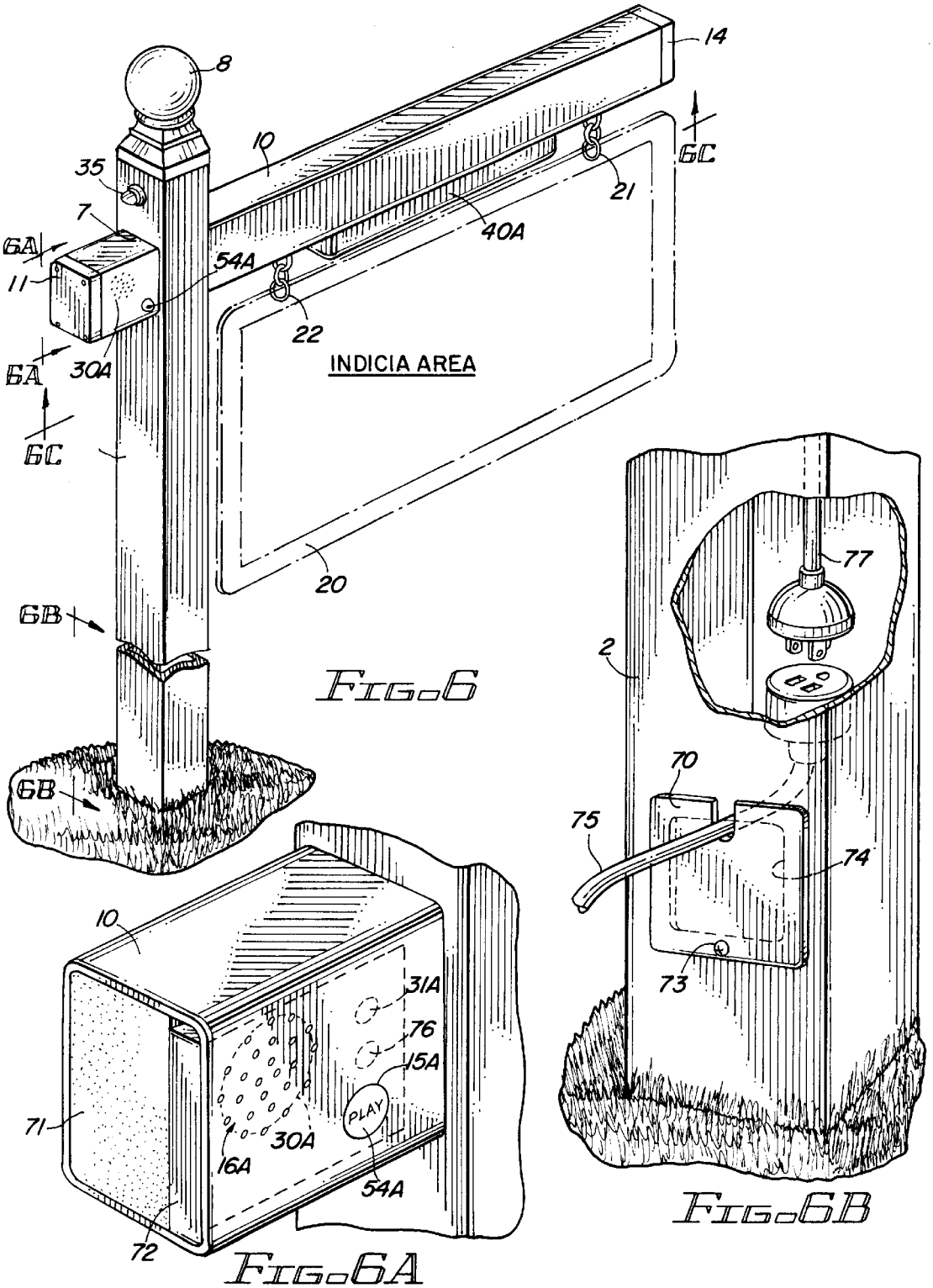
FIG. 6 is a perspective view of a third preferred embodiment of the present invention.
FIG. 6A is an enlarged partial view of the interior of the arm of FIG. 6 showing the placement of a compact unit combining the play back means and play back activation means.
FIG. 6B is an enlarged and partially exposed view of the lower end of the post of FIG. 6.

Referring now to FIGS. 6, and 6A–D, a third preferred embodiment of the present invention is disclosed where the means for recording, means for playing back, means for activating the record means, and means for activating the play back means is preferably in the form of a battery operated, compact, portable, recording/play back device, analog and/or digital (hence, compact voice recorder). A hollow post 2, a hollow arm 10, a topcap 8, and links 21 and 22 were assembled in a similar manner to the embodiments described above. A preferred compact voice recorder 72 was made by removing the cover frame from voice recorder Cat. No. 63-942 in the RADIOSHACK 1997 Catalog, page 197, available from RADIOSHACK, a division of TANDY CORP., Ft. Worth, Tex. Compact voice recorder 72 was then placed inside arm 10 with a block of foam rubber 71 wedged behind recorder 72 so that recorder 72 was held firmly in place against the inside wall of arm 10 in such a manner that a play button 54A and a speaker area 30A of recorder 72 were positioned over apertures 15A and 16A as best shown in FIG. 6A.

To provide lighting to a display panel 20 that might be supported by the instant embodiment, a 120 VAC electrical lamp 40A with a lamp power cord 77 was mounted on the underside of arm 10 so as to be directed toward a display panel 20 (FIGS. 6 and 6C). Lamp power cord 77 was extended through a first lower arm aperture (not visible in the drawings) located in the lower surface of arm 10 and behind lamp 40A into the hollow portion of arm 10, then extended through a second lower arm aperture 38A (seen in FIG. 6C) and finally down through hollow post 2 so that the male plug of lamp cord 77 is accessible through a lower post aperture 74 (shown in FIG. 6B).

Referring now to FIG. 6, a photocell 35 was mounted in an upper post aperture (not visible in drawing) as shown with its wiring extending through post 2 then through an arm aperture 39A (seen in FIG. 6D) and electrically connected to lamp 40A. A notched plate 70 (shown in FIG. 6B) was mounted over lower post aperture 74 with a screw 73. Lower post aperture 74 is for receiving an AC extension cord 75 into the interior of post 2 such that the male plug of cable 77 could be plugged into the female plug of said extension cord thereby enabling 110–120 VAC from an AC outlet to power lamp 40A. As a safety feature, a gasket (not depicted) is preferably placed between plate 70 and post 2 to keep water from entering the interior of post 2.

After assembly, endcap 14 was secured to the relevant open end of arm 10 by appropriate means, and endcap 11 was removably secured to the other end of arm 10 with a keyed cam lock (not depicted) to protect the contents of arm 10 from the weather and vandals yet allow access to the interior of arm 10 for recording a message on recorder 72. To operate, a user need only press play back button 54A to cause the prerecorded message in recorder 72 to be reproduced through speaker 30A.

To use the embodiment just described, endcap 11 and recorder 72 are removed from arm 10 and a message recorded on a voice chip installed inside recorder 72 by the manufacturer by pressing record button 76 then speaking toward microphone 31A. Recorder 72 is then repositioned with foam rubber 71 into arm 10 and endcap 11 replaced. Lamp 40A is plugged into extension cord 75 carrying AC electrical power from a remote 110–120 VAC outlet. Photocell 35 will automatically actuate lamp 40A whenever ambient light is low.

Preferably, each of the embodiments of the present invention disclosed above are erected by first driving a "post sleeve" of the type commonly used in the real estate sales industry into the ground then placing the lower open end of post 2 into the sleeve opening thereby securely holding the standard of the present invention in an upright position. It should be apparent that other means for erecting the standard of the present invention are possible, including shaping the lower end of said post 2 to a pointed shape that can be driven into the ground, or, simply digging a hole into the ground, placing the lower end of the post 2 into said hole then packing post with material such as earth or cement until securely positioned. It may be desirable to place brief instructions such as "Push button for information" (indicating button switch 54) on arm 10 or some other place.

It should be apparent that the various components of the above embodiments, i.e., circuit board 61, compact recorder 72, button switch 54, toggle switch S2, lamps 40, 40A, 41, speaker 30, microphone 31, or photocell 35 may be placed in other workable locations on post 2 or arm 10. It should also be evident that the above embodiments could also be constructed without their respective lighting components.

From the foregoing, it is readily apparent that a useful embodiment of the present invention has been herein described and illustrated which fulfills all of the aforestated objectives in a remarkably unexpected fashion. It is of course understood that such modifications, alterations and adaptations as may readily occur to the artisan confronted with this disclosure are intended within the spirit of this disclosure.

What is claimed is:

1. A display standard for supporting a display panel and processing sound signals on demand, comprising:

an upright support;

panel supporting means located on said upright support;

means for playing back stored sound, said play back means located on said upright support;

power means for providing electrical power to said play back means; and means for activating said play back means, said play back activating means located on said upright support, and electrically connected to said play back means.

2. The display standard according to claim 1, further including panel illuminating means located on said upright support and powered by said power means.

3. The display standard according to claim 1, wherein said panel supporting means is at least one member selected from the group consisting of a link, a bracket, a slot, a hook, a clasp, a fastener, a loop, a coupling, and a clip.

4. The display standard according to claim 1, wherein said power means is a battery, and wherein said battery, said play back means, and said play back activating means are both contained in a compact unit, said compact unit located on said upright support.

5. The display standard according to claim 1, wherein said play back activating means is an electrical switch accessible from the exterior of said upright support.

6. The display standard according to claim 1, wherein said play back means comprises a voice chip and an external circuit having a speaker, wherein said voice chip is an integrated chip that can store input sound signals, and output sound signals stored thereon, and wherein said voice chip is connected to said external circuit.

7. The display standard according to claim 6, wherein said external circuit further includes an amplifying means for amplifying output sound signals received from said voice chip, said amplifying means connected to said speaker.

8. The display standard according to claim 1, further including:

means for recording sound, said recording means located on said upright support and powered by said power means; and, a record activating means electrically connected to said recording means so as to activate said recording means.

9. The display standard according to claim 8, further including panel illuminating means located on said upright support and powered by said power means.

10. The display standard according to claim 8, wherein said panel supporting means is at least one member selected from the group consisting of a link, a bracket, a slot, a hook, a clasp, a fastener, a loop, a coupling, and a clip.

11. The display standard according to claim 8, wherein said power means, said play back means, said recording means, said play back activating means, and said record activating means are all contained in a compact unit, said compact unit located on said upright support such that said play back activating means is located on said upright support so as to be activatable from the exterior of said upright support.

12. The display standard according to claim 11, wherein said power means is a battery.

13. The display standard according to claim 8, wherein said record activating means and said play back activating means cooperatively include a first switch and a second switch, wherein said first switch is accessible from the exterior of said upright support and said second switch has a first and a second contact position, said first and second switches electrically connected to said play back means and said recording means in such a way that said play back means is activated whenever said first switch is activated at the same time said second switch is in a first position, and, said recording means is activated whenever said first switch is activated at the same time said second switch is in a second position.

14. The display standard according to claim 8, wherein said recording means and said play back means cooperatively include a voice chip and an external circuit having a speaker and a microphone, wherein said voice chip is an integrated chip that can store input sound signals, and output sound signals stored thereon, and wherein said voice chip is connected to said external circuit.

15. The display standard according to claim 14, wherein said external circuit further includes an amplifying means for amplifying output sound signals from said voice chip, said amplifying means connected to said speaker.

16. A display standard for supporting a display panel and processing sound signals on demand, comprising:

an upright support comprising a hollow post and a hollow orthogonal arm;

a pair of links fixed to said arm;

an activatable voice chip, said voice chip capable of storing input sound signals and producing as output the sound signals stored therein;

an external circuit connected to said voice chip, wherein said external circuit includes: a zero insertion force socket for receiving said voice chip, said socket located on a printed circuit board mounted within said hollow upright support; a speaker mounted on a first aperture of said upright support and electrically connected to said voice chip; and a first electrical switch having a button activating portion, said first switch mounted on a second aperture of said upright support so that said button portion of said electrical switch is accessible from the exterior of said upright support, said first switch also electrically connected to said voice chip such that said voice chip outputs sound signals stored therein to said speaker whenever said first switch is activated; and means for supplying electrical power.

17. The display standard according to claim 16, further including:

at least one lamp mounted on said upright support, said lamp powered by said power means; and a photocell electrically connected to said lamp.

18. The display standard according to claim 16, wherein said external circuit further includes:

a microphone mounted on a third aperture of said upright support, said microphone electrically connected to said voice chip; and a key operated toggle switch having a first and a second position, wherein said key switch is electrically connected to said first switch and to said voice chip in such a way that said voice chip stores input sound signals corresponding to sound received by said microphone whenever said first switch is activated while said key switch is in said first position, and such that sound signals stored on said voice chip are output to said speaker whenever said first switch is activated while said key switch is in said second position.

19. The display standard according to claim 18, further including:

at least one lamp mounted on said upright support, said lamp powered by said power means; and a photocell electrically connected to said lamp.

20. A display standard for supporting a display panel and processing sound signals on demand, comprising:

a hollow upright support comprising a hollow post and a hollow orthogonal arm;

a pair of links fixed to said arm;

a compact voice recorder/player having a play back function, a record function, a microphone, a speaker, a voice chip, a first button for activating said play back function, a second button for activating said record function, and a battery; wherein said compact recorder/player is removably mounted in said hollow display standard and aligned with at least one aperture in said upright support such that said first button is publicly accessible, that sound which comes from said speaker is unobstructed by said upright support, and further, such that said second button is operably inaccessible from the exterior of said upright support.

21. The display standard according to claim 20, further including a lamp with an electrical cord having a plug, said lamp mounted on said upright support, wherein said cord extends through said hollow post toward a post aperture;

a photocell mounted on said upright support, said photocell electrically connected to said lamp;

a means for powering said lamp; and a removable notched plate covering said post aperture for receiving and extending said power means into the interior of said post and to said lamp cord plug.

22. The display standard according to claim 8, wherein said means for activating said recording means is publicly inaccessible.

23. A display standard for supporting a display panel and processing sound signals on demand, comprising:

an upright support adapted so as to be able to bear a display panel;

an activatable sound playback device for audibly playing back stored sound, said playback device located on said upright support; and a power supply electrically connected to said playback device.

24. The display standard according to claim 23, further including an activatable sound recording device, said recording device located on said upright support and powered by said power supply.

25. The display standard according to claim 23, wherein said playback device operates on a removable sound recording storage device.

26. The display standard according to claim 24, wherein activation of said recording device is publicly inaccessible.

27. The display standard according to claim 24, wherein said playback and said recording device operate on a removable sound recording storage device.

* * * * *